US006729943B2

(12) United States Patent
Kistler et al.

(10) Patent No.: US 6,729,943 B2
(45) **Date of Patent: *May 4, 2004**

(54) SYSTEM AND METHOD FOR CONTROLLED POLISHING AND PLANARIZATION OF SEMICONDUCTOR WAFERS

(75) Inventors: Rod Kistler, Los Gatos, CA (US); Yehiel Gotkis, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/025,379

(22) Filed: Dec. 18, 2001

(65) Prior Publication Data

US 2002/0137436 A1 Sep. 26, 2002

Related U.S. Application Data

(63) Continuation of application No. 09/493,978, filed on Jan. 28, 2000, now Pat. No. 6,340,326.

(51) Int. Cl.[7] ..... B24B 29/00; B24B 5/00

(52) U.S. Cl. ..... 451/286; 451/443

(58) Field of Search ..... 451/21, 56, 57, 451/65, 286, 288, 388, 398, 443, 444

(56) References Cited

U.S. PATENT DOCUMENTS

| | | | |
|---|---|---|---|
| 3,589,078 | A | 6/1971 | Bala et al. |
| 4,128,968 | A | 12/1978 | Jones |
| 4,144,099 | A | 3/1979 | Edmonds et al. |
| 4,197,676 | A | 4/1980 | Sauerland |
| 4,232,485 | A | 11/1980 | Eadon-Allen |
| 4,358,338 | A | 11/1982 | Downey et al. |
| 4,462,860 | A | 7/1984 | Szmanda |
| 4,693,036 | A | 9/1987 | Mori |
| 5,177,908 | A | 1/1993 | Tuttle |

(List continued on next page.)

FOREIGN PATENT DOCUMENTS

| | | | |
|---|---|---|---|
| EP | 0 150 074 | A2 | 7/1985 |
| EP | 0 180 175 | A2 | 5/1986 |
| EP | 0 272 531 | A1 | 6/1988 |
| EP | 0 272 531 | B1 | 6/1988 |
| EP | 0 337 379 | A2 | 10/1989 |
| EP | 0 754 525 | A1 | 1/1997 |
| EP | 0 916 452 | A2 | 5/1999 |
| EP | 0 992 322 | A1 | 4/2000 |
| EP | 1 057 591 | A2 | 12/2000 |
| GB | 2 324 750 | A | 11/1998 |
| JP | 7-111256 | | 4/1995 |
| WO | WO 82/03038 | | 9/1982 |

OTHER PUBLICATIONS

Copy of Patents Abstracts of Japan, for Publication No. 05318325, Publication Date Mar. 12, 1993, "Grinding Wheel for Grinding Work and Its Electrolytic Dressing Method", 1 page.

Copy of Patent Abstracts of Japan, for Publication No. 2000015557, Publication Date Jan. 18, 2000, "Polishing Device", 1 page.

Copy of International Search Report received for related PCT/US01/01044, filed on Jan. 12, 2001, date of mailing May 21, 2001.

Copy of International Search Report received for related PCT/US01/48658, filed Dec. 13, 2002, date of mailing Dec. 16, 2002.

*Primary Examiner*—Dung Van Nguyen
(74) *Attorney, Agent, or Firm*—Brinks Hofer Gilson & Lione

(57) ABSTRACT

A system and method for polishing semiconductor wafers includes a rotatable polishing pad movably positionable in a plurality of partially overlapping configurations with respect to a semiconductor wafer. A pad dressing assembly positioned coplanar, and adjacent, to the wafer provides in-situ pad conditioning to a portion of the polishing pad not in contact with the wafer. The method includes the step of radially moving the polishing pad with respect to the wafer.

13 Claims, 4 Drawing Sheets

U.S. PATENT DOCUMENTS 5,245,790 A 9/1993 Jerbic
5,265,378 A 11/1993 Rostoker
5,310,455 A 5/1994 Pasch et al.
5,321,304 A 6/1994 Rostoker
5,389,194 A 2/1995 Rostoker et al.
5,403,228 A 4/1995 Pasch
5,441,444 A 8/1995 Nakajima
5,508,077 A 4/1996 Chen et al.
5,516,400 A 5/1996 Pasch et al.
5,599,423 A 2/1997 Parker et al.
5,624,304 A 4/1997 Pasch et al.
5,632,873 A 5/1997 Stevens et al.
5,645,469 A 7/1997 Burke et al.
5,667,433 A 9/1997 Mallon
5,672,095 A 9/1997 Morimoto et al.
5,709,593 A 1/1998 Guthrie et al.
5,736,427 A 4/1998 Henderson
5,861,055 A 1/1999 Allman et al.
5,865,666 A 2/1999 Nagahara
5,868,608 A 2/1999 Allman et al.
5,882,251 A 3/1999 Berman et al.
5,888,120 A 3/1999 Doran
5,893,756 A 4/1999 Berman et al.
5,895,270 A 4/1999 Hempel, Jr.
5,897,426 A 4/1999 Somekh
5,919,082 A 7/1999 Walker et al.
5,948,697 A 9/1999 Hata
5,957,757 A 9/1999 Berman
5,964,646 A 10/1999 Kassir et al.
5,969,521 A 10/1999 Kurita et al.
5,972,162 A 10/1999 Cesna
5,975,991 A 11/1999 Karlsrud
5,975,994 A * 11/1999 Sandhu et al. ..... 451/56
6,004,193 A * 12/1999 Nagahara et al. ..... 451/285
6,004,196 A * 12/1999 Doan et al. ..... 451/443
6,010,538 A 1/2000 Sun et al.
6,030,488 A 2/2000 Izumi et al.
6,041,465 A 3/2000 Yashiki et al.
6,048,259 A 4/2000 Asai
6,062,954 A 5/2000 Izumi
6,066,230 A 5/2000 Arai
6,068,545 A 5/2000 Arai
6,074,275 A 6/2000 Yashiki et al.
6,074,277 A 6/2000 Arai
6,075,606 A 6/2000 Doan
6,083,082 A 7/2000 Saldana
6,093,087 A 7/2000 Hakomori et al.
6,102,784 A 8/2000 Lichner
6,106,662 A 8/2000 Bibby, Jr. et al.
6,113,478 A 9/2000 Anderson, III et al.
6,168,508 B1 1/2001 Nagahara et al.
6,328,632 B1 12/2001 Chopra
6,340,326 B1 * 1/2002 Kistler et al. ..... 451/286
6,402,588 B1 * 6/2002 Matsuo et al. ..... 451/5
6,431,959 B1 8/2002 Mikhaylich et al.
2001/0012751 A1 8/2001 Boyd et al.

* cited by examiner

SYSTEM AND METHOD FOR CONTROLLED POLISHING AND PLANARIZATION OF SEMICONDUCTOR WAFERS

CROSS REFERENCE TO RELATED APPLICATIONS

This application is a continuation of application Ser. No. 09/493,978, filed Jan. 28, 2000, which is hereby incorporated by reference, now U.S. Pat. No. 6,340,526.

FIELD OF THE INVENTION

The present invention relates to planarization of semiconductor wafers using a chemical mechanical planarization technique. More particularly, the present invention relates to an improved system and method for planarizing semiconductor wafers in a controlled manner over a variable geometry contact area.

BACKGROUND

Semiconductor wafers are typically fabricated with multiple copies of a desired integrated circuit design that will later be separated and made into individual chips. A common technique for forming the circuitry on a semiconductor wafer is photolithography. Part of photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive for smaller, more highly integrated circuit designs which cannot tolerate certain nonuniformities within a particular die or between a plurality of dies on a wafer. Because semiconductor circuit on wafers are commonly constructed in layers, where a portion of a circuit is created on a first layer and conductive vias connect it to a portion of the circuit on the next layer, each layer can add or create topography on the wafer that must be smoothed out before generating the next layer. Chemical mechanical planarization (Oxide-CMP) techniques are used to planarize and polish each layer of a wafer. CMP (Metal-CMP) is also widely used to shape within-die metal plugs and wires, removing excess metal from the wafer surface and only leaving metal within the desired plugs and trenches on the wafer. Available CMP systems, commonly called wafer polishers, often use a rotating wafer holder that brings the wafer into contact with a polishing pad rotating in the plane of the wafer surface to be planarized. A chemical polishing agent or slurry containing microabrasives and surface modifying chemicals is applied to the polishing pad to polish the wafer. The wafer holder then presses the wafer against the rotating polishing pad and is rotated to polish and planarize the wafer. Some available wafer polishers use orbital motion, or a linear belt rather than a rotating surface to carry the polishing pad. In all instances, the surface of the wafer is often completely covered by, and in contact with, the polishing pad to simultaneously polish the entire surface. One drawback of polishing the entire surface simultaneously is that the various circuits on the wafer, even if the wafer begins the CMP process perfectly flat, may have a different response to the CMP process. This may be due to the different types of materials deposited on parts of the wafer or the density of materials on a certain portion of the wafer. Simultaneous polishing of the entire surface will often clear some spots of the wafer faster than others because of this differential, uneven rate of clearing and may result in overpolishing of certain areas of the wafer. Various material processes used in formation of wafers provide specific challenges to providing a uniform CMP polish to a wafer. One of the more recent processes used, the copper dual damascene process, can be particularly sensitive to the overpolishing that may occur in polishers that simultaneously polish the entire surface of a wafer. Also, the trends to process larger diameter wafers has introduced an additional level of difficulty to the CMP process by requiring uniformity over a greater surface area.

Accordingly, there is a need for a method and system of performing CMP that addresses these issues.

DETAILED DESCRIPTION OF THE PRESENTLY PREFERRED EMBODIMENTS

Figure 1:
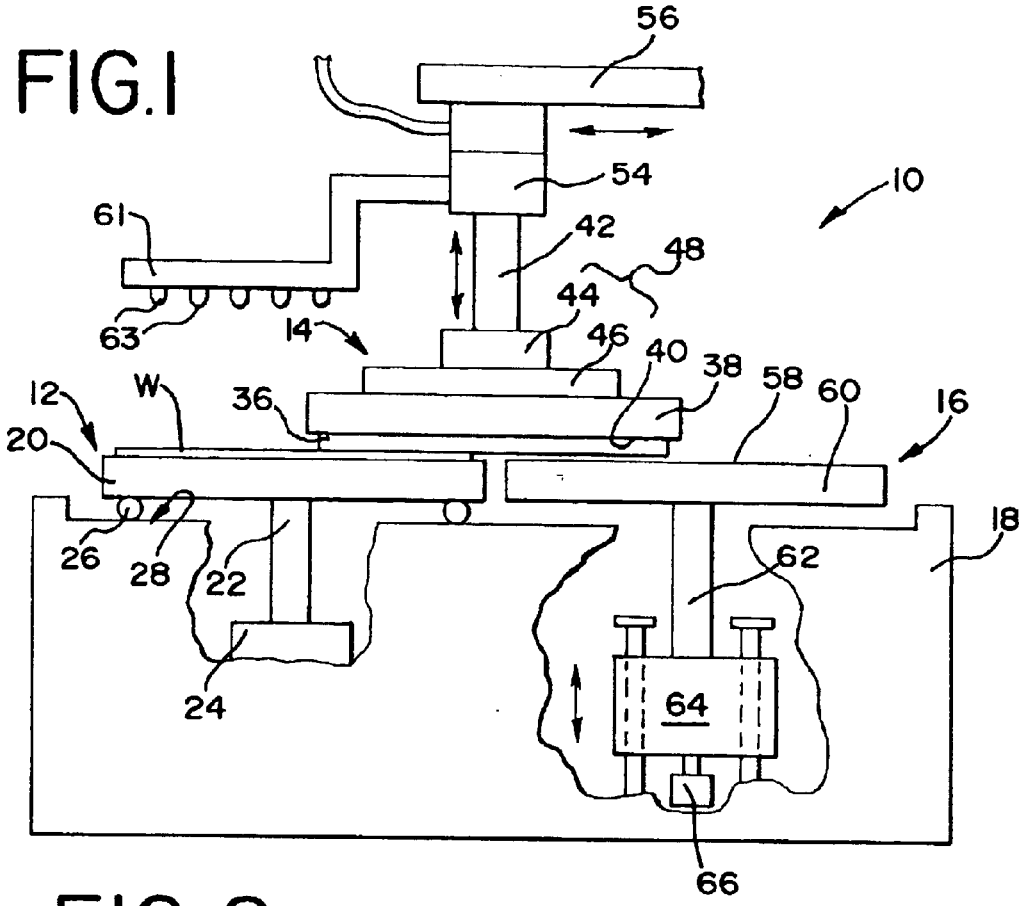
FIG. 1 is a side cut-away view of a semiconductor wafer polishing system according to a preferred embodiment.

In order to address the drawbacks of the prior art described above, a wafer polisher is disclosed below that can provide improved polishing performance and flexibility, as well as avoid over-polishing and assist with improving polishing uniformity of wafers produced with difficult to planarize layers such as those produced using copper processes. A preferred embodiment of a wafer polisher 10 is illustrated in FIG. 1. The polisher 10 includes a wafer carrier assembly 12, a pad carrier assembly 14 and a pad dressing assembly 16. Preferably, the wafer carrier assembly 12 and pad dressing assembly 16 are mounted in a frame 18. The wafer carrier assembly includes a wafer head 20 mounted on a shaft 22 rotatably connected to a motor 24. In a preferred embodiment, the wafer head 20 is designed to maintain a rigid planar surface that will not flex or bend when polishing pressure is received from the pad carrier assembly 14. Preferably, a circular bearing 26, or other type of support, is positioned between the wafer head 20 and an upper surface 28 of the frame 18 along a circumference of the wafer head 20 in order to provide additional support to the wafer head 20. Alternatively, the wafer carrier assembly 20 may be constructed with a shaft 22 having sufficient strength to avoid any deflections.

Figure 2:
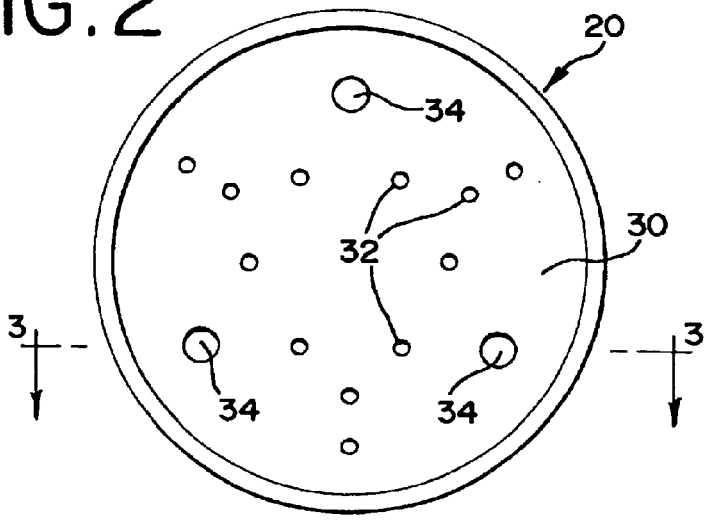
FIG. 2 is a top plan view of a wafer carrier assembly suitable for use in the system of FIG. 1.
Figure 3:
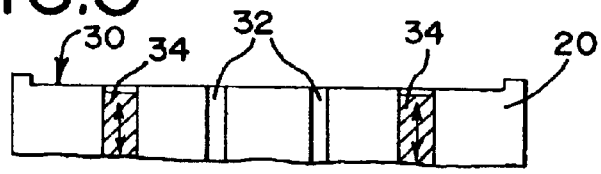
FIG. 3 is a sectional view taken along line 3—3 of FIG. 2.

The wafer head 20 of the wafer carrier assembly 12 is further described with respect to FIGS. 2 and 3. The wafer head 20 preferably has a wafer receiving region 30 for receiving and maintaining a semiconductor wafer in a fixed position during polishing. The wafer receiving area 30 may be a recessed area as shown in FIG. 3 or may be an area centered at the center of rotation of the wafer head 20. Any of a number of known methods for maintaining contact between the wafer and the wafer head 20 during CMP processing may be implemented. In a preferred embodiment, the wafer receiving area 30 of the head 20 includes a plurality of air passages 32 for providing a flow of air, or receiving a vacuum, useful in maintaining or releasing the wafer from the wafer head 20. A porous ceramic or metal material may also be used to allow for a vacuum to be applied to a wafer. Other methods of maintaining the wafer against the wafer carrier, for example adhesives, a circumferentially oriented clamp, or surface tension from a liquid, may be used. One or more wafer lifting shafts 34 are movably positioned between a recessed location within the wafer head and a position extending away from the wafer receiving area 30 of the head 20 to assist in loading and unloading a wafer from a wafer transport mechanism, such as a robot. Each wafer lifting shaft may be operated pneumatically, hydraulically, electrically, magnetically or through any other means. In another preferred embodiment, the wafer head 20 may be fabricated without any wafer lifting shafts 34 and wafers may be loaded or unloaded from the wafer head using a vacuum assisted method.

Referring again to FIG. 1, the pad carrier assembly 14 includes a polishing pad 36 attached to a pad support surface 40 of a pad carrier head 38. The polishing pad 36 may be any of a number of known polishing materials suitable for planarizing and polishing semiconductor wafers. The polishing pad may be the type of pad used in conjunction with abrasive slurry, such as the IC 1000 pad available from Rodel Corporation of Delaware. Alternatively, the pad may be constructed of a fixed abrasive material that does not require an abrasive containing slurry. Although the diameter of the polishing pad 36 is preferably equal to, or substantially the same as, the diameter of the wafer W, other diameter ratios of the polishing pad and wafer are contemplated. In one embodiment, the polishing pad size may be anywhere in the range of the size of a single die on the wafer to an area twice as large as that of the wafer. Pad dressing surfaces having a an area greater than that of the wafer may be advantageous to account for a wider range of motion of the polishing pad, for example in situations where the polishing pad is moved in a manner that would position the center of the polishing pad off of an imaginary line formed between the center of the wafer and the center of the pad dressing surface. In embodiments where more than a single pad dressing head are contemplated, the area of the pad dressing heads is preferably sufficient to condition and support the polishing pad used.

The pad carrier head 38 is preferably attached to a spindle 42 through male and female 44, 46 portions of a tool changer 48. The tool changer preferably allows for interchangeability between pad carrier heads 38 so that different CMP processes may be applied to the same wafer by changing wafer heads and any associated types of abrasive polishing chemistries.

Figure 4:
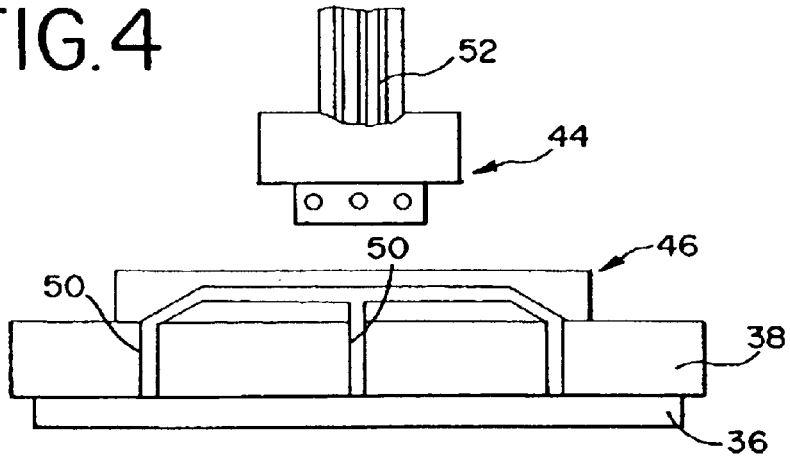
FIG. 4 is an exploded sectional view of a polishing pad carrier assembly and tool changer suitable for use in the system of FIG. 1.

As shown in FIG. 4, a pad 36 may receive abrasive slurry through passages 50 from the pad carrier head 38 and tool changer 44, 46 that are fed by one or more slurries applied lines 52 that may be within the spindle 42. The spindle is rotatably mounted within a spindle drive assembly 54 mounted to a spindle transport mechanism 56. The transport mechanism may be any of a number of mechanical, electrical or pneumatic devices having a controllable reciprocating or orbital motion, or a rotating arm mechanism, that are capable of moving the polishing pad to a plurality of discrete positions on the wafer during a polishing operation.

The spindle drive assembly 54 is designed to rotate the polishing pad 36 on the polishing pad carrier head 38 and it is designed to allow for movement of the spindle to move the polishing pad towards or away from the plane of the wafer W as well as apply a totally controlled polishing pressure to the wafer during CMP processing. It also allows easy access to the pad carrier and facilities assembly automatic replacement of the polishing pad. A suitable spindle drive assembly, such as the one used in the TERES™ polisher available from Lam Research Corporation in Fremont, Calif., may be used to accomplish this task. The spindle transport mechanism 56 may be any of a number of mechanical or electrical devices capable of transporting the spindle in a direction coplanar to the wafer W being polished. In this manner, the polishing pad 36 may be precisely positioned and/or oscillated, if required, in a linear direction about a position along a radius of the wafer W.

A pad dressing assembly 16 is preferably positioned adjacent to the wafer carrier assembly and opposite the pad carrier assembly 14. The pad dressing assembly 16 is designed to provide in-situ and ex-situ conditioning and cleaning of the polishing pad 36.

In one embodiment, the size of the active surface 58 of the pad dressing assembly 16 is preferably substantially the same as the area of the polishing pad. The active surface of the pad dressing assembly may also be larger or smaller than the area of the polishing pad in other embodiments. Additionally, the pad dressing assembly may also consist of multiple rotatable surfaces in other embodiments.

Preferably, the pad dressing assembly 16 has a surface 58 coplanar with the surface of the wafer W being processed The size of the active area of the pad dressing assembly is at least as great as that of the polishing pad 36, consisting of a single or smaller multiple heads). The surface 58 of the pad dressing assembly 16 is affixed to a pad dressing head 60 attached to a shaft 62 rotatably mounted in a motor 64. In order to assist in maintaining the planarity of the pad dressing surface 58 with the wafer W, a plane adjustment mechanism 66 may be used to adjust the position of the pad dressing assembly 16.

In one embodiment, the plane adjustment mechanism 66 may be a mechanical device that may be loosened, adjusted to compensate for height variations, and retightened, between CMP processing runs. In one alternative embodiment, the plane adjustment mechanism may be an active mechanically, or electrically driven device, such as a spring or pneumatic cylinder, that continuously puts an upward pressure on the pad dressing head 60 such that the pressure of the pad carrier assembly 14 against the pad dressing surface 58 maintains a pad dressing surface in a coplanar relationship with the wafer W mounted on the wafer carrier assembly 12. In yet another embodiment, a three point balancing device, having three separately height adjustable shafts, may be used to adjust the plane of the pad dressing surface and/or the wafer carrier head. As with the wafer carrier assembly 12, the pad dressing head 60 may be supported by a circular bearing or may be supported by the shaft 62 alone.

Figure 5A:
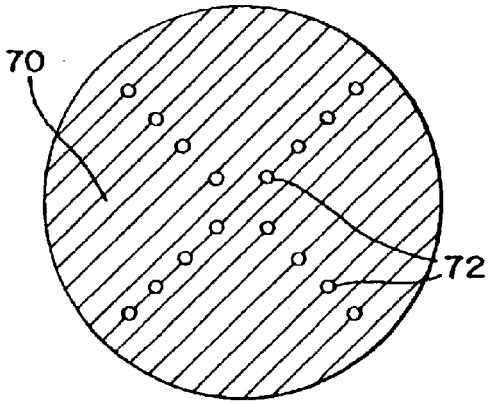
FIGS. 5A–5D illustrate top plan views of different embodiments of a surface of a pad dressing assembly suitable for use in the system of FIG. 1.

Referring to FIGS. 5A–D, several embodiments of preferred pad dressing surfaces positioned on the pad dressing head 60 are shown. In FIG. 5A, the pad dressing surface may be completely covered with a fixed abrasive media 70 such as alumina, ceria and diamond available from 3M and Diamonex. In addition, a plurality of orifices 72 for transporting a fluid, such as deionized water, slurry or other desired chemistry spray, are dispersed across the surface.

The active surface of the pad dressing assembly may consist of a single dressing feature, such as a diamond coated plate or pad, or may consist of a combination of several pieces of different materials. In other preferred embodiments, the surface of the pad dressing head is divided in sections and includes a set of various standard sized pad conditioning sections, such as a fixed abrasive unit, a brush and spray unit, sprayers and other types of known pad dressing services. Depending on the desired pad dressing performance, each section of the surface of the pad dressing head may have independently controllable actuators that provide for rotational and up/down motion, and a liquid supply port.

Figure 5B:
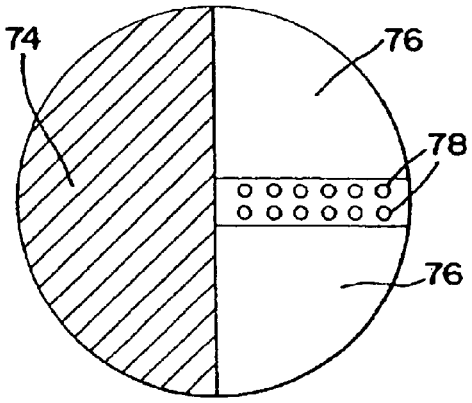
Figure 5C:
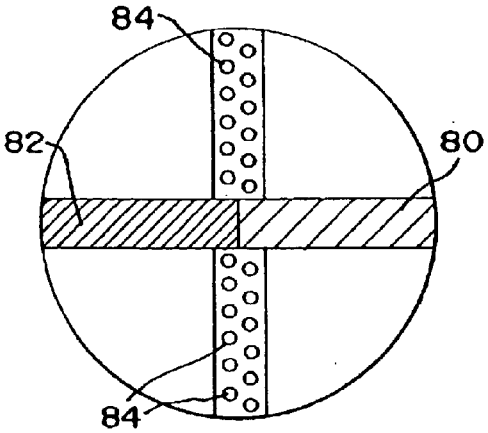
Figure 5D:
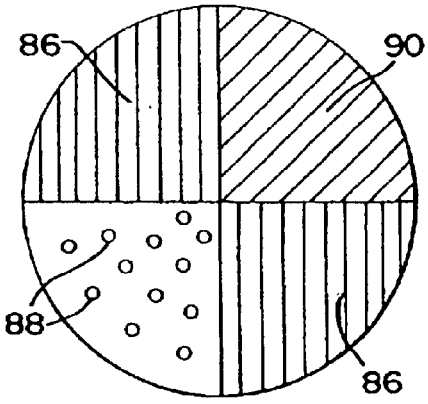

As shown in FIG. 5*b,* the pad dressing surface may have a fixed abrasive 74 on one half of the surface, a clean pad 76 on the opposite half of the surface, and an array of fluid dispensing orifices 78 positioned along the clean pad section. The clean pad may be a poromeric material such as Polytex available from Rodel Corporation. In another preferred embodiment, the pad dressing surface may contain a strip of diamond grit 80, a nylon brush 82 positioned along another radius and a plurality of fluid orifices 84 perpendicular to the strip of nylon brush and diamond media as shown in FIG. 5C. Another preferred embodiment is illustrated in FIG. 5D, wherein a fixed abrasive substance 86 is positioned on opposite quarters of the surface while a plurality of fluid orifices 88 and a clean pad 90 are each positioned on a respective one of the remaining two quarters of the surfaces. Any of a number of configurations of abrasive material to abrade and condition the pad, a fluid to rinse the pad, and/or clean pad materials may be utilized. Additionally, any suitable fixed abrasive or fluid may be used.

The polisher 10 of FIGS. 1–5 is preferably configured with the wafer carrier assembly and pad dressing assembly having a co-planar relationship between their respective surfaces. As provided above, the co-planarity may be manually adjusted or self-adjusting. Also, the pad dressing head and wafer carrier head are preferably positioned as close together radially as possible so that the maximum amount of polishing pad material will be conditioned. Preferably, the surface of the pad dressing head is large enough, and positioned close enough to the wafer carrier, such that the entire polishing pad is conditioned after one complete rotation of the pad. In other embodiments, multiple pad dressing devices may be used to condition the same or different portions of the pad. In these alternative pad dressing embodiments, the surface of each pad dressing assembly may be arrayed radially with respect to the wafer carrier head, or may be arrayed in any other desired fashion.

In a preferred embodiment, each of the wafer carrier, pad carrier, and pad dressing assemblies may be constructed having heads that are non-gimbaled. In another embodiment, the pad carrier head may be a gimbaled head, such as those commonly known in the industry, to compensate for minor inaccuracies in the alignment of the interacting wafer surface, polishing pad and pad dressing surface. Also, the wafer carrier head and pad dressing head are preferably oriented with their respective surfaces facing in an upward direction, while the pad carrier head faces downward. An advantage of this wafer up configuration is that it can assist in improved in-situ surface inspection, end point detection and direct supply of liquids to the wafer surface. In other embodiments, the wafer and pad dressing heads, and the opposing pad carrier head, may be oriented parallel to a non-horizontal plane, such as a vertical plane, or even completely reversed (i.e., polishing pad facing up and wafer and pad dressing surface facing down) depending on space and installation constraints.

Figure 6:
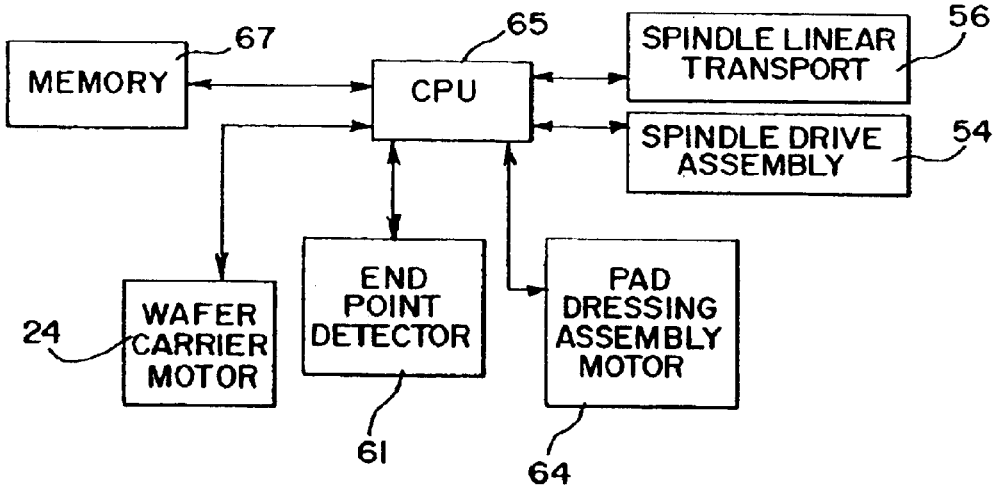
FIG. 6 is a block diagram illustrating the communication lines between the microprocessor and the individual components of the polisher of FIG. 1.

As shown in FIG. 6, the polisher 10 is controllable by a microprocessor (CPU) 65 based on instructions stored in a programmable memory 67. The instructions may be a list of commands relating to wafer specific polishing schemes that are entered or calculated by a user based on a combination of operational parameters to be sensed or maintained by the various components of the polisher. These parameters may include rotational speed of the carrier heads for the pad, wafer and pad dressing components, position/force information from the spindle drive assembly 54, radial pad position information from the spindle linear transport mechanism 56, and polishing time as maintained by the CPU and adjusted in process by information from the end point detector 61. The CPU is preferably in communication with each of the different components of the polisher.

Figure 7:
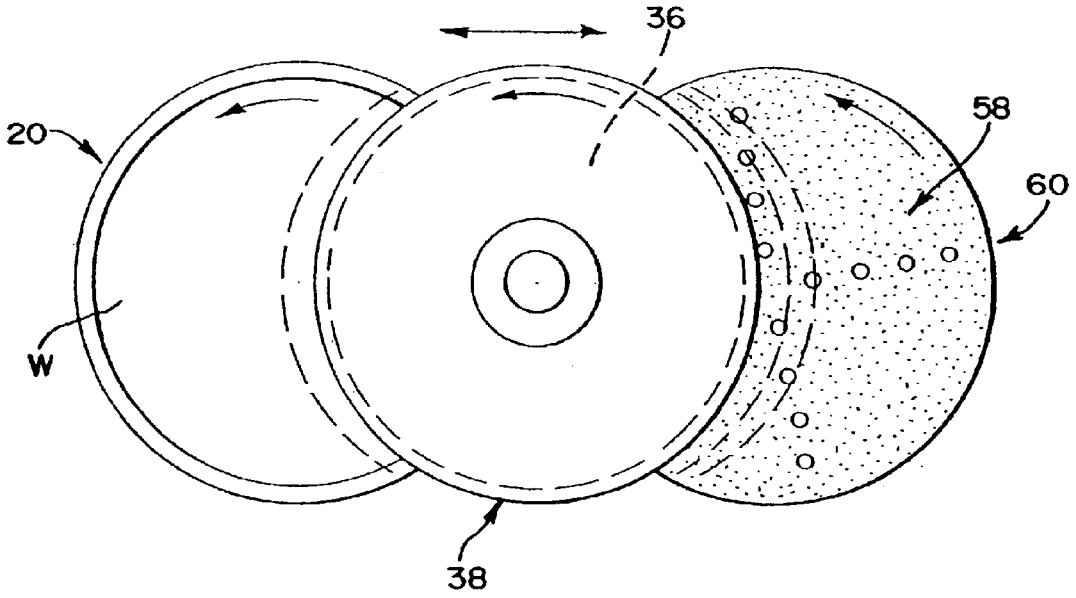
FIG. 7 is a top plan view illustrating the movement of the components of the system of FIG. 1.

With reference to the polisher 10 described in FIGS. 1–6 above, operation of the polisher is described below. After a wafer is loaded onto the wafer carrier, the polishing pad is lowered by the spindle drive assembly such that polishing pad overlaps only a portion of the surface of the wafer as shown in FIG. 7. Although the polisher can be operated to completely cover the surface of the wafer with the pad, the pad is preferably only covering, and in contact with, a portion of the wafer surface at any given time. Also, a portion of the polishing pad that is not covering the wafer is preferably covering, and in contact with, the surface of the pad dressing assembly. Thus, as one portion of the polishing pad rotates and presses against a portion of the rotating wafer, another portion of the polishing pad is rotating against the rotating surface of the pad dressing assembly to clean and condition the polishing pad on each rotation of the pad. Preferably the entire polishing pad is utilized in this continuous process of polishing and pad conditioning.

Preferably, the polisher 10 is capable of addressing regional variations in uniformity on a wafer-by-wafer basis. This function is achieved by first obtaining profile information on each wafer and calculating a polishing strategy for the polisher to address the particular non-uniformities of each wafer. The wafer profile information may be obtained from earlier measurements determined in processing earlier layers of the particular wafer, or may be measured expressly before the wafer is processed. Any one of a number of known profile measurement techniques may be used to obtain the necessary profile data. For example, a resistance measurement using a four point probe may be taken at points from the center of the wafer to the edge to determine profile properties. These properties may be used in conjunction with the previously measured properties of the polishing pad (for example, the measured polishing response at various points along the radius of the polishing pad) to calculate the best polishing scheme (e.g., polishing pad path, rotational speed of the wafer and pad, downforce applied to the pad, and time at each point on the polishing path) and store these instructions in the polisher memory for execution by the CPU.

Prior to, and after, polishing the wafer, the wafer lifting shafts 38 in the wafer carrier assembly 12 are activated to lift the wafer from the wafer receiving surface and transfer the wafer to or from the wafer carrying robot. Also, during the CMP process on a particular wafer, it is preferred that the wafer, polishing pad, and pad dressing surface all rotate in the same direction. Other combinations of rotational directions are contemplated and rotational speed of the individual assemblies may vary and be varied purposefully during a particular polishing run.

Once the polishing scheme is determined and stored, and the wafer is properly mounted in the wafer carrier, polishing may progress according to the predetermined polishing scheme. The pad, wafer and pad dressing surface will all be rotated at a desired speed. Suitable rotational speeds for the pad, wafer and pad dressing surface may be in the range of 0–700 revolutions per minute (r.p.m.). Any combination of rotational speeds and rotational speeds of greater than 700 r.p.m. are also contemplated. The linear transport mechanism for the spindle will position the edge of the pad at the first point along the radius of the wafer and the spindle drive assembly will lower the pad until it reaches the surface of the wafer and the desired pressure is applied. The polishing pad preferably only covers a portion of the wafer and continues to polish the wafer until the desired polishing time has expired. Preferably, the process status inspection system, which may be an end point detector 61 (FIG. 1) having one or more transmitter/receiver nodes 63, communicates with the CPU to provide in-situ information on the polishing progress for the target region of the wafer and to update the original polishing time estimate. Any of a number of known surface inspection and end point detection methods (optical, acoustic, thermal, etc.) may be employed. While a predetermined polishing strategy may be applied to each individual wafer, the signal from surface inspection tool may be used for precise adjustment of the time spent by the polishing pad at each location.

After polishing the first region of the wafer, the linear index mechanism moves the polishing pad to the next position and polishes that region. The polishing pad preferably maintains contact with the surface of the wafer as it is moved to the next radial position. Additionally, while the polisher may move the polishing pad from a first position, where the edge of the polishing pad starts at the center of the wafer, to subsequent positions radially away from the center in consecutive order until the wafer edge is reached, the profile of a particular wafer may be best addressed by moving in other linear paths. For example the first polish operation may start with the edge of the polishing pad at a point in between the center and edge of the wafer and the polisher may move the polishing pad to positions along the wafer radius toward the edge, and finishing with a final polish with the edge of the pad at the center of the wafer.

During polishing, the polishing pad is preferably constantly in contact with the surface of the pad dressing assembly. The pad dressing assembly conditions the pad to provide a desired surface and cleans by-products generated by the polishing process. The abrasive material on the surface of the pad dressing assembly preferably activates the pad surface while pressurized deionized water or other suitable chemical cleanser is sprayed through the orifices in the surface and against the pad.

Using the CPU to monitor the pressure applied by the spindle to the pad carrier head and controllably rotate the pad carrier head and the wafer, the polishing process proceeds until the end point detector indicates that the polisher has finished with a region. Upon receiving information from the end point detector, the CPU instructs the spindle linear transport mechanism 56 to radially move the polishing pad with respect to the center of the wafer to draw the polishing pad away from the center of the wafer and focus on the next annular region of the wafer. Preferably, the pad and the wafer maintain contact while the pad is withdrawn radially towards the edge of the wafer. In a preferred embodiment, the spindle linear transport mechanism 56 may simply index in discrete steps movement of the pad. In another preferred embodiment, the spindle mechanism 56 may index between positions and oscillate back and forth in a radial manner about each index position to assist in smooth transitions between polish regions on the wafer.

In another embodiment, the linear spindle transport mechanism may move in discrete steps, maintain the spindle in a fixed radial position after each step and make use of a polishing pad that is offset from the center of rotation of the polishing pad carrier to provide an oscillating-type movement between the pad and the wafer. As is apparent from the figures, the polishing pad dressing not only maintains constant contact with the wafer, it also maintains constant contact with the surface of the pad dressing assembly. Each rotation of the polishing pad will bring it first across the wafer and then into contact with various portions of the surface of the pad dressing assembly.

The polisher 10 may be configured to allow for the pad to completely overlap the wafer, however the pad preferably indexes between various partially overlapping positions with respect to the wafer to assist in avoiding within wafer nonuniformity. Advantages of this configuration and process include the ability to focus the removal rate at various annular portions of the wafer to provide greater polish control and avoid over polish problems often associated with polishing an entire surface of a wafer simultaneously. Further, the partial overlapping configuration permits continuous, in-situ pad conditioning.

Although a single pad dressing assembly is shown, multiple pad dressing assemblies may also be implemented. An advantage of the present polisher 10 is that in-situ pad conditioning may be performed as well as in-situ end point detection based on the fact that the wafer and polishing pad preferably do not completely overlap. Additionally, by starting the overlap of the pad and wafer at a point no greater than the radius of the polishing pad, the polishing pad may be completely conditioned each rotation. Furthermore, cost savings may be achieved by fully utilizing the surface of the polishing pad. Unlike several prior art systems, where the polishing pad is significantly larger than the wafer being polished, the entire surface of the polishing pad is potentially utilized.

Figure 8:
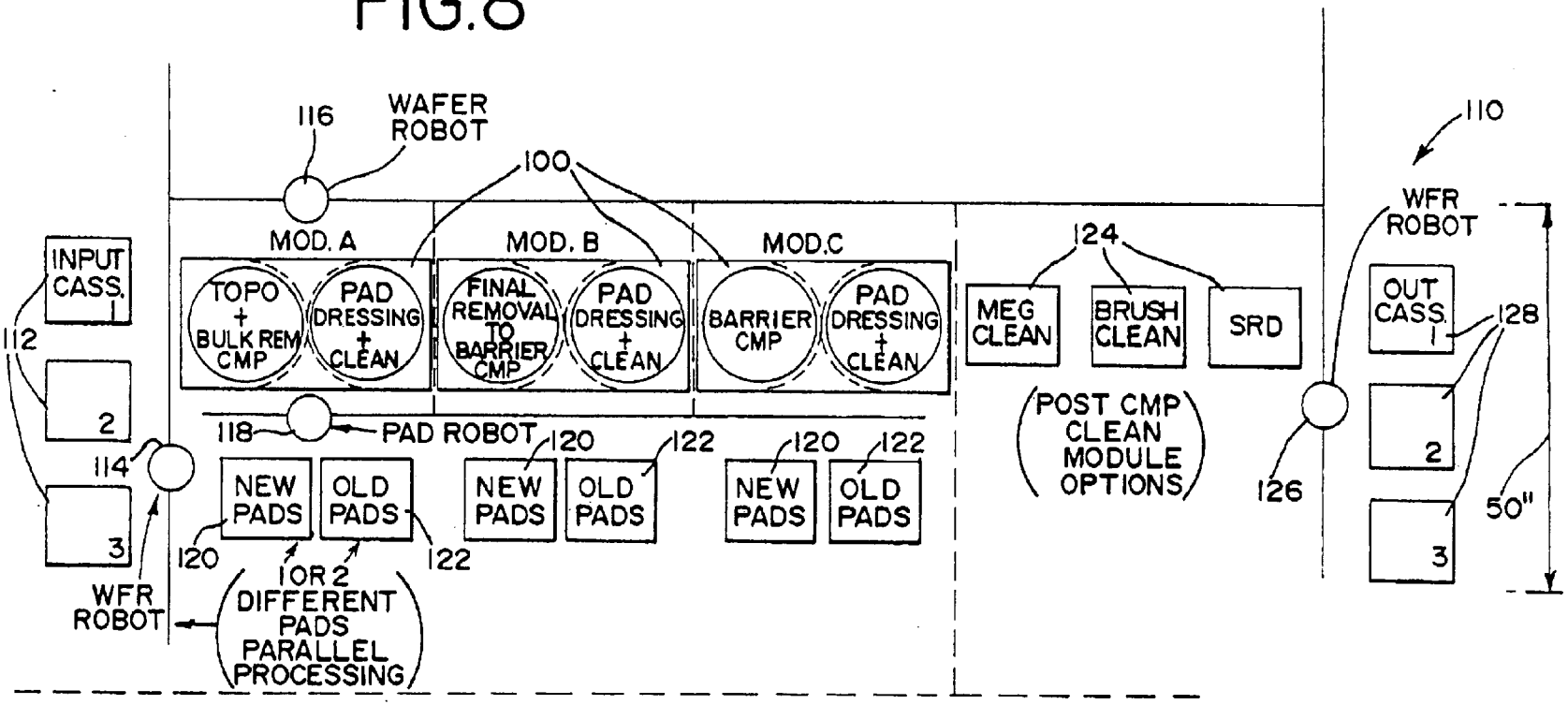
FIG. 8 is a diagram illustrating a wafer processing system incorporating the wafer polisher of FIG. 1.

In other embodiment, the polisher 10 shown in FIGS. 1–7, may be used as a module 100 in a larger wafer processing system 110 as shown in FIG. 8. In the system of FIG. 8, multiple modules are linked in series to increase wafer throughput. The wafer processing system 110 preferably is configured to receive semiconductor wafers loaded in standard input cassettes 112 that require planarization and polishing. A wafer transport robot 114, may be used to transfer individual wafers from the cassettes to the first module 100 for polishing. A second wafer transport robot may be used to transfer the wafer to the next module upon completion of processing at the first module as described with respect to the polisher 10 of FIG. 1. The system 110 may have as many modules 100 as desired to address the particular polishing needs of the wafers. For example, each module could be implemented with the same type of pad and slurry combination, or no slurry if fixed abrasive techniques are used, and each wafer would be partially planarized at each module such that the cumulative effect of the individual polishes would result in a completely polished wafer after the wafer receives its final partial polish at the last module.

Alternatively, different pads or slurries could be used at each module. As described above with respect to the polisher of FIG. 1, each polisher module 100 may change polishing pad carriers through the use of a tool changer. This additional flexibility is attainable in the system of FIG. 8 through the use of a pad robot 118 that may cooperate with the spindle drive assembly of each module to switch between pads automatically without the need to dismantle the entire system. Multi-compartment pad carrier head storage bins for fresh pads 120 and used pads 122 may be positioned adjacent each module to permit efficient changing of pad carrier heads attached to worn pads with pad carrier heads having fresh pads. Utilizing a cataloging mechanism, such as a simple barcode scanning technique, wafer pad carriers having different types of pads may be catalogued and placed at each module so that numerous combinations of pads may be assembled in the system 100.

After planarization, the second wafer robot 116 may pass the wafer on to various post CMP modules 124 for cleaning and buffing. The post CMP modules may be rotary buffers, double sided scrubbers, or other desired post CMP devices. A third wafer robot 126 removes each wafer from the post CMP modules and places them in the output cassettes when polishing and cleaning is complete.

It is intended that the foregoing detailed description be regarded as illustrative rather than limiting, and that it be understood that the following claims, including all equivalents, are intended to define the scope of this invention.

We claim:

1. A semdiconductor wafer polisher comprising:

a rotatable wafer carrier having a wafer receiving surface for releasably retaining a semiconductor wafer;

a rotatable polishing pad carrier having a polishing pad oriented substantially parallel to the wafer receiving surface and configured to movably position the polishing pad at a plurality of partially overlapping positions with respect to the semiconductor wafer, wherein the polishing pad contacts and rotates against a portion of a surface of the semiconductor wafer; and a rotatable pad dressing assembly having a surface comprising a polishing pad conditioning material, the surface of the polishing pad dressing assembly positioned substantially coplanar with the surface of the semiconductor wafer on the wafer carrier, wherein the rotatable pad dressing assembly rotates and contacts a first portion of the polishing pad, while a second portion of the pad polishes the semiconductor wafer.

2. The polisher of claim 1, wherein the rotatable polishing pad carrier comprises an index mechanism configured to move the polishing pad in a linear, radial direction with respect to the semiconductor wafer.

3. The polisher of claim 2, wherein the polishing pad carrier further comprises a polishing pad carrier head removably attached to a spindle.

4. The polisher of claim 3, wherein the polishing pad carrier further comprises a spindle drive assembly connected with the linear index mechanism and the spindle, the spindle drive assembly configured to rotate the spindle and move the polishing pad against the semiconductor wafer.

5. The polisher of claim 4, wherein the linear index mechanism is configured to move the polishing pad to a plurality of partially overlapping positions with the surface of the wafer and the pad dressing surface, the linear index mechanism being adjustable between a first position where the polishing pad has a greater portion of the pad in contact with the surface of the wafer than with the pad dressing surface, and a second position where a greater portion of polishing pad is positioned over the pad dressing surface than the surface of the wafer.

6. The polisher of claim 1, wherein the wafer receiving surface of the rotatable wafer carrier comprises a plurality of fluid orifices for receiving one of a vacuum and a pressurized fluid, wherein the semiconductor wafer is releasably attachable to the wafer receiving surface.

7. A semiconductor wafer polisher comprising:

a rotatable wafer carrier having a wafer receiving surface for releasably retaining a semiconductor wafer, the rotatable wafer carrier comprising a fixed axis of rotation;

a rotatable pad dressing assembly having a surface comprising a polishing pad conditioning material, the rotatable pad dressing assembly having an axis of rotation parallel to the axis of rotation of the rotatable wafer carrier;

a rotatable polishing pad carrier having a polishing pad oriented substantially parallel to the wafer receiving surface, the rotatable polishing pad carrier radially movable and configured to movably position the polishing pad at a plurality of partially overlapping positions with respect to the semiconductor wafer, wherein the polishing pad contacts and rotates against a portion of a surface of the semiconductor wafer;

wherein the semiconductor wafer and the polishing pad conditioning material simultaneously contact the polishing pad and partially overlap the polishing pad during a polishing operation.

8. The polisher of claim 7, wherein the rotatable polishing pad carrier is detachably connected with a spindle mounted to a linear index mechanism, the linear index mechanism configured to move the spindle in a linear, radial direction with respect to the semiconductor wafer.

9. The polisher of claim 7, wherein the rotatable pad dressing assembly is axially adjustable, whereby the polishing pad material is maintained substantially coplanar with the semiconductor wafer.

10. The polisher of claim 7, wherein the each of the rotatable wafer carrier, rotatable pad dressing assembly and rotatable polishing pad carrier comprise a non-gimbaled head.

11. A semiconductor wafer polisher comprising:

a rotatable wafer carrier having a wafer receiving surface for releasably retaining a semiconductor wafer, the rotatable wafer carrier comprising a fixed axis of rotation;

a rotatable pad dressing assembly having a surface comprising a polishing pad conditioning material, the rotatable pad dressing assembly having an axis of rotation parallel to the axis of rotation of the rotatable wafer carrier;

a rotatable polishing pad carrier having a gimbaled head configured to adjustably maintain a surface of a polishing pad in a substantially parallel orientation with respect to the wafer receiving surface, the rotatable polishing pad carrier radially movable and configured to movably position the polishing pad at a plurality of partially overlapping positions with respect to the semiconductor wafer, wherein the polishing pad contacts and rotates against a portion of a surface of the semiconductor wafer;

wherein the semiconductor wafer and the polishing pad conditioning material simultaneously contact the polishing pad and partially overlap the polishing pad during a polishing operation.

12. The polisher of claim 11, wherein the head of the rotatable polishing pad carrier is detachably connected with a spindle mounted to a linear index mechanism, the linear index mechanism configured to move the spindle in a linear, radial direction with respect to the semiconductor wafer.

13. The polisher of claim 11, wherein the rotatable pad dressing assembly is axially adjustable, whereby the polishing pad material is maintained substantially coplanar with the semiconductor wafer.

* * * * *